US012305908B2

(12) United States Patent
Clay et al.

(10) Patent No.: US 12,305,908 B2
(45) Date of Patent: May 20, 2025

(54) SELF-CONTAINED REACH-IN REFRIGERATOR

(71) Applicant: True Manufacturing Company, Inc., O'Fallon, MO (US)

(72) Inventors: Brandon Clay, O'Fallon, MO (US); Christopher Moonier, O'Fallon, MO (US)

(73) Assignee: TRUE MANUFACTURING CO., INC., O'Fallon, MO (US)

( * ) Notice: Subject to any disclaimer, the term of this patent is extended or adjusted under 35 U.S.C. 154(b) by 0 days.

(21) Appl. No.: 18/644,567

(22) Filed: Apr. 24, 2024

(65) Prior Publication Data

US 2024/0271856 A1 Aug. 15, 2024

Related U.S. Application Data

(62) Division of application No. 17/564,559, filed on Dec. 29, 2021, now Pat. No. 11,994,335.

(51) Int. Cl.

| | |
|---|---|
| ***F25D 21/14*** | (2006.01) |
| ***F25D 17/06*** | (2006.01) |
| ***F25D 21/08*** | (2006.01) |

(52) U.S. Cl.

CPC ..... *F25D 21/14* (2013.01); *F25D 17/067* (2013.01); *F25D 21/08* (2013.01); *F25D 2321/1441* (2013.01)

(58) Field of Classification Search

CPC ..... F25D 21/14; F25D 21/08; F25D 21/06; F25D 17/067; F25D 2321/14; F25D 2321/1413; F25D 23/067

See application file for complete search history.

(56) References Cited

U.S. PATENT DOCUMENTS

| | | | | |
|---|---|---|---|---|
| 2013/0255301 | A1* | 10/2013 | Correa | F25D 21/14 62/291 |
| 2018/0010844 | A1* | 1/2018 | Booz | F24F 13/222 |
| 2019/0226775 | A1* | 7/2019 | Lorang | F24F 1/02 |

FOREIGN PATENT DOCUMENTS

| | | | | |
|---|---|---|---|---|
| EP | 1783445 | A1 * | 5/2007 | F25D 21/08 |
| EP | 3309482 | A1 * | 4/2018 | F25D 17/067 |
| EP | 2454540 | B1 * | 9/2020 | F25D 17/065 |

* cited by examiner

*Primary Examiner* — Joseph F Trpisovsky

(74) *Attorney, Agent, or Firm* — Stinson LLP

(57) ABSTRACT

A self-contained reach-in refrigerator has self-contained refrigeration system connected to a cabinet. A drain pan is below an evaporator of the refrigeration system. A thermally conductive bridge member provides thermal conduction between a defrost heater and the drain pan. An upper wall defining a top end of a product space in the cabinet can include a drain pan section below the evaporator, a fan section extending forward from the drain pan section, and a rear lip extending upward from a rear end of the drain pan section. The evaporator fan can be supported over the fan section to draw air from the product space through the fan section. A support member can be fastened to the rear lip to support the upper wall.

14 Claims, 17 Drawing Sheets

SELF-CONTAINED REACH-IN REFRIGERATOR

REFERENCE TO RELATED APPLICATION

This application is a Divisional of U.S. application Ser. No. 17/564,55, filed Dec. 29, 2021, the entire disclosure of which is incorporated herein by reference.

FIELD

The present disclosure generally relates to a self-contained reach in refrigerator, such as a refrigerated display case or merchandiser.

BACKGROUND

Various restaurant, retail, and medical establishments employ commercial refrigerators to keep cold-stored goods at chilled or frozen (broadly, below-ambient) temperatures. Some commercial refrigerators are self-contained units having factory-installed refrigeration systems integrated with a storage unit. Some commercial refrigerators employ reach-in cabinets. Energy-efficiency and reliability are important characteristics of self-contained reach-in refrigerators.

SUMMARY

In one aspect, a self-contained reach-in refrigerator comprises a cabinet defining a product space. A self-contained refrigeration system is connected to the cabinet. The self-contained refrigeration system comprises an evaporator, a compressor, a condenser, an expansion device, and interconnecting tubing. A defrost heater is in thermal communication with the evaporator for selectively defrosting the evaporator. A drain pan is below the evaporator. A thermally conductive bridge member provides thermal conduction between the defrost heater and the drain pan.

In another aspect, a self-contained reach-in refrigerator comprises a cabinet defining a product space having a front-to-back depth, a width, and an upper end. A self-contained refrigeration system is connected to the cabinet. The self-contained refrigeration system comprises an evaporator, a compressor, a condenser, an expansion device, and interconnecting tubing. An evaporator fan is configured to draw air from the product space across the evaporator to cool the air and discharge cooled air into the product space. A defrost heater is in thermal communication with the evaporator for selectively defrosting the evaporator. An upper wall in the cabinet defines the upper end of the product space. The upper wall includes a drain pan section below the evaporator, a fan section extending forward from the drain pan section, and a rear lip extending upward from a rear end of the drain pan section. The evaporator fan is supported over the fan section to draw air from the product space through the fan section. A support member is fastened to the rear lip. The support member is separate from the cabinet and configured to support the upper wall within the cabinet.

Other aspects will be in part apparent and in part pointed out hereinafter.

BRIEF DESCRIPTION OF THE DRAWINGS

Corresponding parts are given corresponding reference characters throughout the drawings.

DETAILED DESCRIPTION

Figure 1:
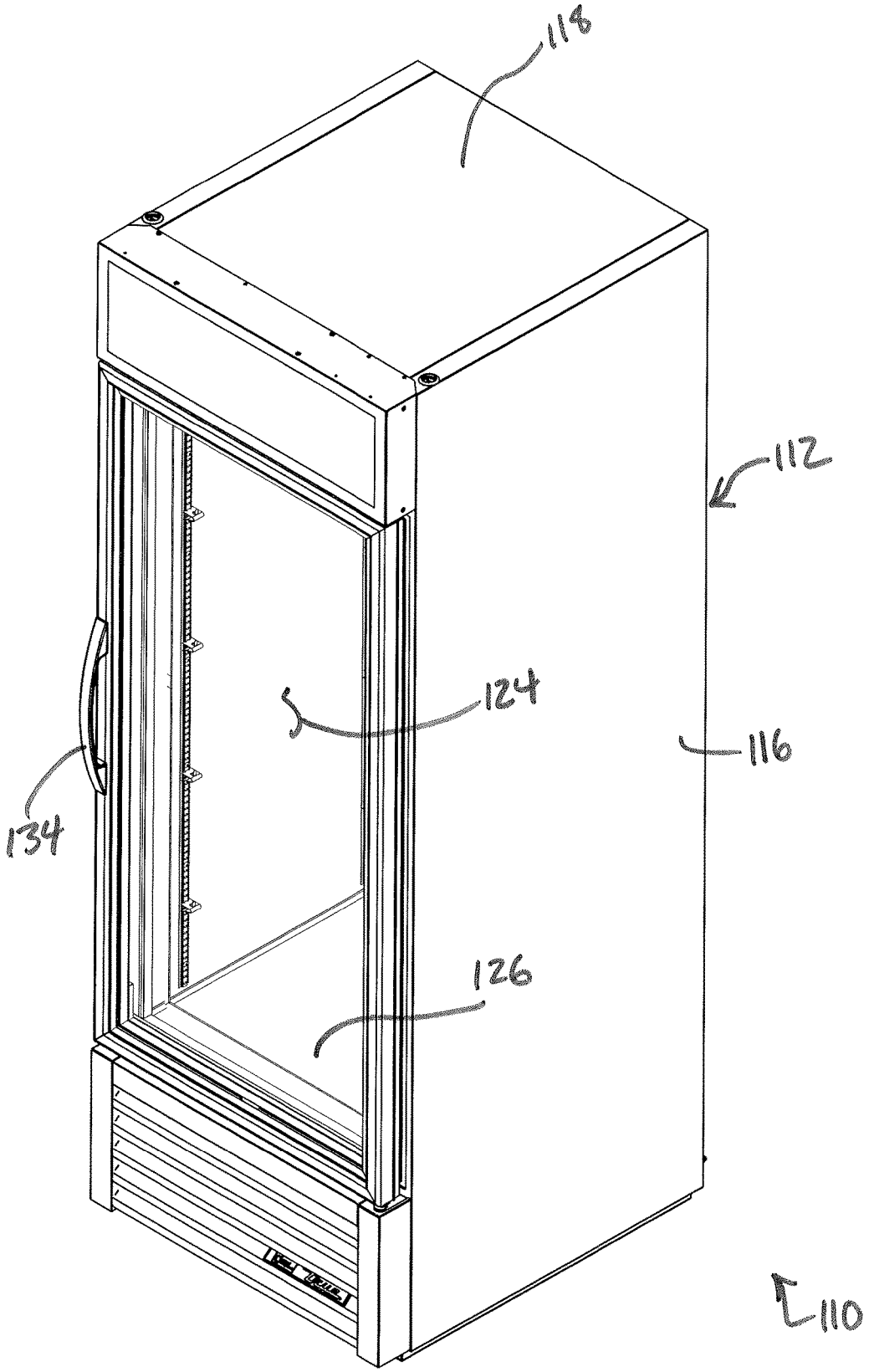
FIG. 1 is a perspective of a self-contained reach-in refrigerator.
Figure 2:
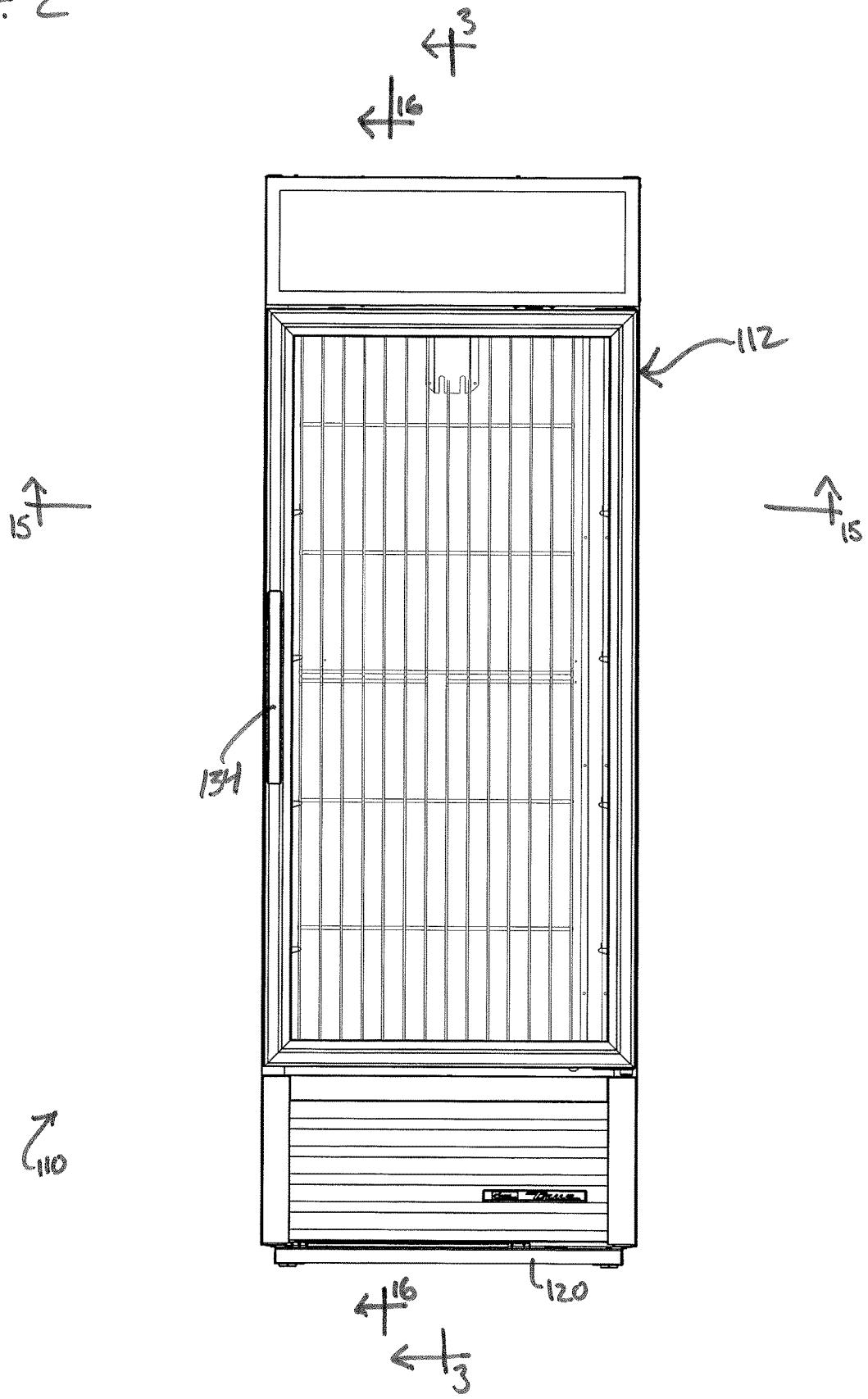
FIG. 2 is a front elevation of the self-contained reach-in refrigerator.
Figure 3:
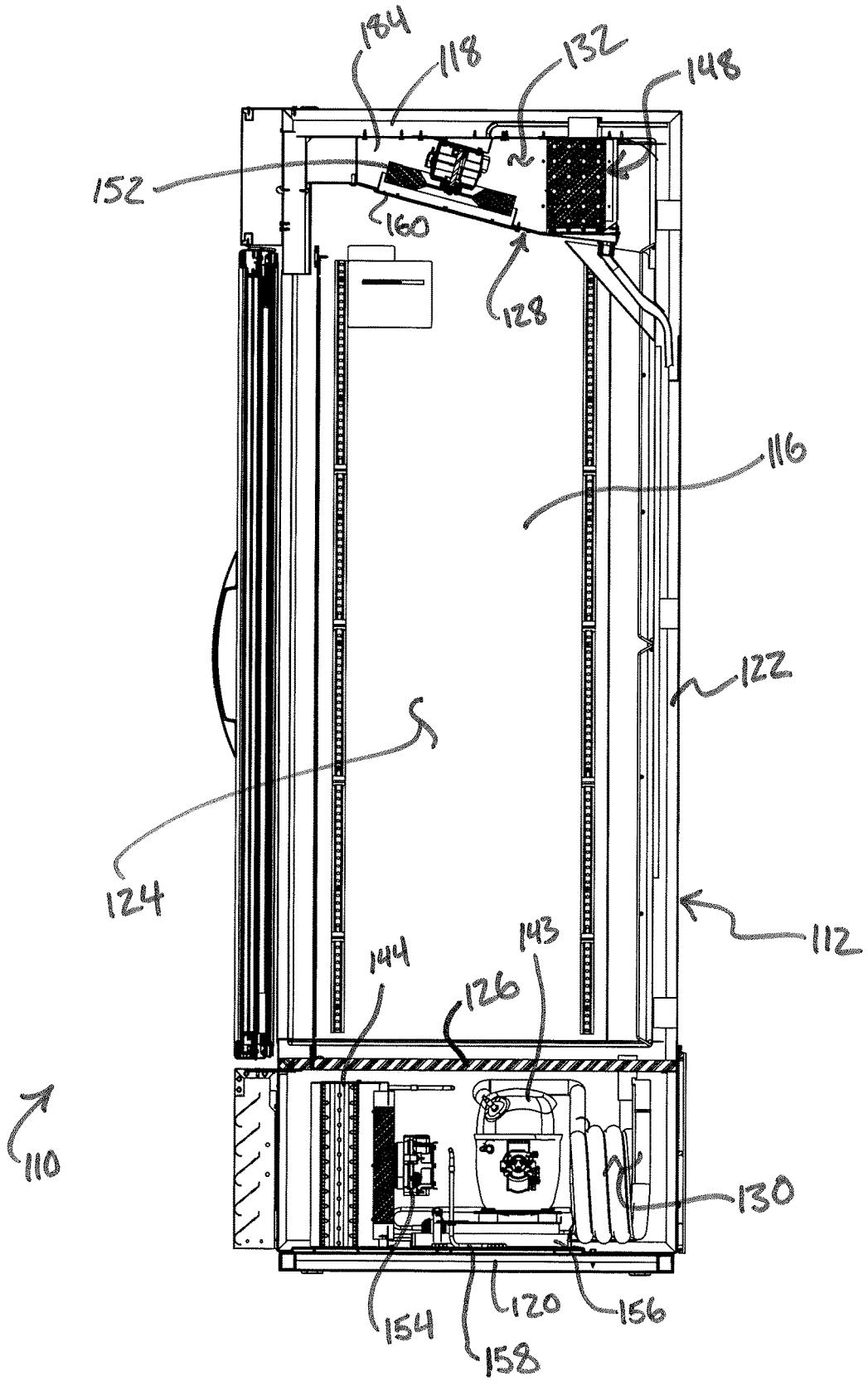
FIG. 3 is a cross section taken in the plane of line 3-3 of FIG. 2.

Referring now to FIGS. 1-3, an exemplary embodiment of a self-contained reach-in refrigerator in accordance with the present disclosure is generally indicated at reference number 110. Throughout this disclosure, the term "refrigerator" is used broadly to encompass any storage device with a refrigeration system used to maintain internal temperatures below ambient conditions. For example, "refrigerator" encompasses coolers configured to maintain chilled internal temperatures above 1° C. and freezers configured to maintain internal temperatures below 0° C. An individual "refrigerator" encompassed in the scope of this disclosure may also be capable of operating in more than one cooling mode, e.g., selectively operable as a cooler for internal temperatures above 1° C. or as a freezer for internal temperatures below 0° C. Throughout this disclosure, the term "self-contained" is used to refer to a refrigerator that is a prefabricated assembly of both a storage device and a complete refrigeration system. Those skilled in the art will appreciate that a "self-contained" refrigerator is a distinct type of device from a "remote" refrigerator. In this disclosure, "reach-in" is used to describe the type of storage device. A "reach-in" refrigerator comprises an upright cabinet with a front opening for accessing product within the cabinet. The upright cabinet defines a product space that is accessible to a user of normal size and capability by reaching into the product space through the front opening. "Reach-in" refrigerators in the scope of the disclosure can comprise one or more doors (e.g., one or more hinged doors or sliding doors) or air curtains.

The illustrated self-contained reach-in refrigerator 110 comprises an upright reach-in cabinet 112 made up of a set of insulated walls that separate part of the interior of the cabinet from the exterior or ambient environment of the cabinet. The cabinet 112 comprises a pair of side walls 116 spaced apart along a width of the cabinet, a top wall 118 and a bottom support 120 spaced apart along a height of the cabinet, and a back wall 122 running heightwise and widthwise along a back side of the cabinet.

The cabinet 112 defines a product space 124 inside the cabinet. The side walls 116 define the lateral sides of the product space. The self-contained reach-in refrigerator 110 further comprises a lower wall 126 that defines the bottom end of the product space 124 and an upper wall 128 that defines the top end of the product space. In the illustrated embodiment, the lower wall 126 comprises insulation that thermally insulates the product space 124 from a condenser chamber 130 below the product space. By contrast, the upper wall 128 is not insulated, yet it is configured define the top end of the product space 124 and to provide division between the product space and an evaporator plenum 132. The illustrated upper wall 128 has several features that are believed to contribute to improved energy efficiency and reliability in the self-contained reach-in refrigerator 110, as will be described in further detail below. Although the illustrated self-contained reach-in refrigerator 110 comprises a condenser chamber 130 below the product space 124 and an evaporator plenum 132 above the product space, it will be understood that reach-in refrigerators could have other configurations (e.g., with evaporator and condenser both positioned above or below the product space) without departing from the scope of the disclosure.

The illustrated cabinet 112 comprises a single hinged door 134 for selectively opening and closing a doorway (broadly, a front opening) to the product space. It will be understood, however, that aspects of the present disclosure can be employed on refrigerator cabinets comprising multiple doors, sliding doors, or air curtains, in lieu of the single hinged door 134 of the illustrated embodiment.

In certain embodiments, the self-contained reach-in refrigerator 110 is configured for use as a display case, or more broadly, a merchandiser. Those skilled in the art will recognize that such merchandisers comprise doors 134 with insulated glass providing a line of sight to the product space 124 through the door. Typically, the insulated glass is heated to prevent fog from forming on the glass during opening and closing of the refrigerator. It is contemplated that a self-contained reach-in refrigerator 110 can comprise heated door glass in one or more embodiments. But in certain embodiments, such as embodiments that will not be deployed in tropical environments, the inventors contemplate that the glass door 134 can be non-heated to minimize energy consumption. When the door glass is non-heated, the inventors contemplate applying an unpowered anti-fog film to the door glass to inhibit condensation from obstructing the view through the door glass. In certain embodiments, the anti-fog film can be a modified cellulose diacetate film, such as Clarifoil AF1 or AF1000 film. In an exemplary embodiment, the door 134 comprises a triple-pane insulated glass unit ("IGU"), with argon filling the two spaces between the three glass panes (see FIG. 5). Suitably, the IGU includes a first perimeter seal between the front glass pane and the middle glass pane and a second perimeter seal between the middle glass pane and the rear glass pane. In an exemplary embodiment, the first and second perimeter seals are formed from a thermally insulating material, such as silicone foam, that attaches to the glass panes via adhesive (e.g., acrylic adhesive) and comprises a multi-layer vapor barrier that substantially limits leakage across the seal. A suitable spacer material is Super Spacer® material, available from Quanex building products. In certain embodiments, at least the front and the middle panes are formed from glass with a low-E coating on the interior-facing side. Suitably, the anti-fog film is applied to the interior surface of the rear glass pane.

Figure 4:
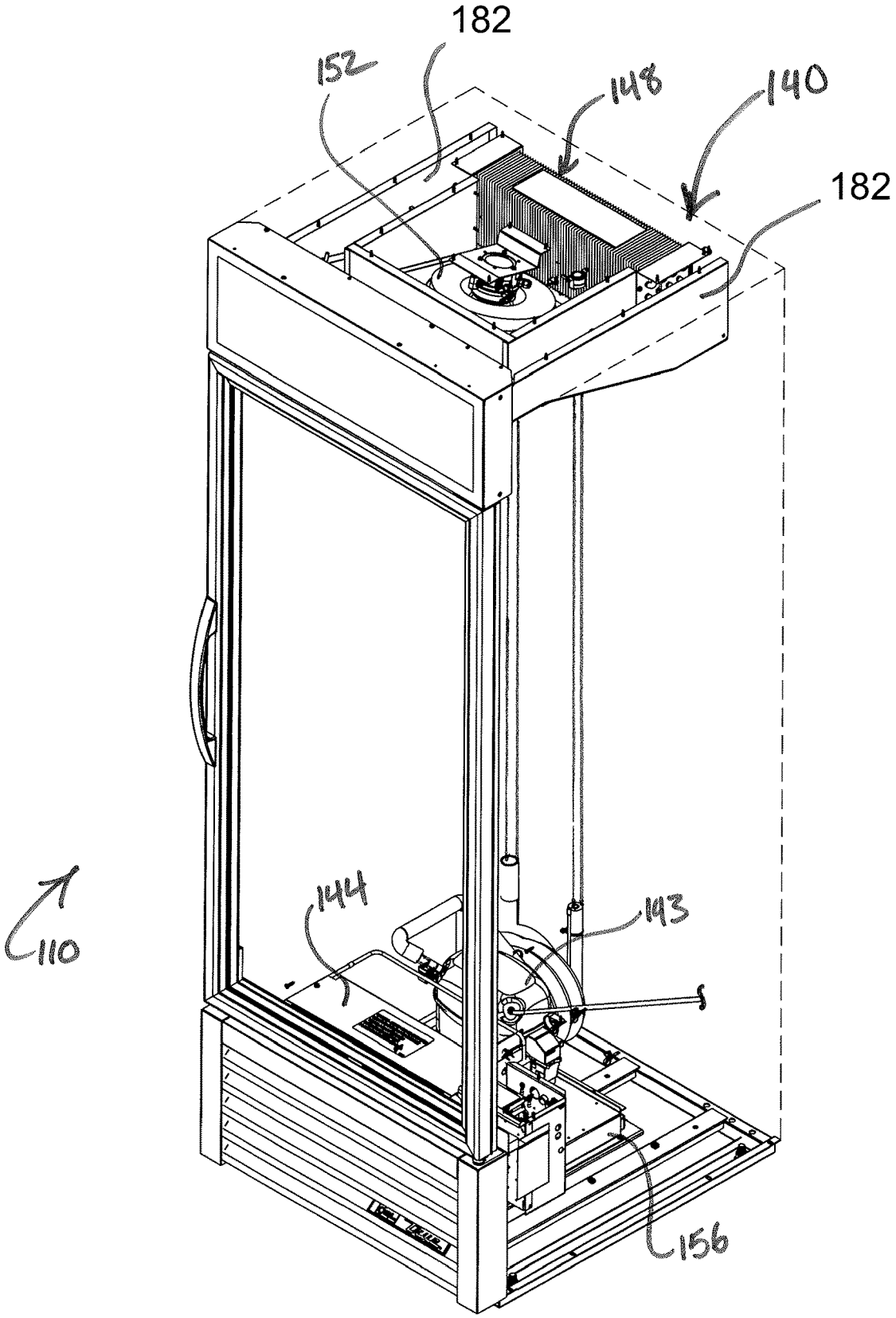
FIG. 4 is a perspective of the self-contained reach-in refrigerator in which the outside walls of the self-contained reach-in refrigerator are shown in phantom to reveal refrigeration system components.

Referring to FIGS. 3 and 4, the self-contained reach-in refrigerator 110 comprises a refrigeration system 140 connected to the cabinet 112 for cooling the interior storage space 124. In the illustrated embodiment, the refrigeration system 140 comprises a vapor compression refrigeration system. In an exemplary embodiment, the vapor compression refrigeration system 140 is charged with natural gas refrigerant, such as r290. In certain embodiments, the refrigeration system 140 is hermetically sealed with no access points or leak points through which refrigerant can escape the refrigeration system. As shown, the vapor compression refrigeration system 140 comprises a compressor 143, a condenser 144, a capillary tube (broadly, an expansion device; not shown), an evaporator 148, and refrigeration tubing connecting the compressor, the condenser, the capillary tube, and the evaporator. Those skilled in the art will be familiar with the basic components, functions, and operations of the components of the above-described vapor compression refrigeration system 140. The compressor 143 can either be fixed speed or variable speed.

Figure 5:
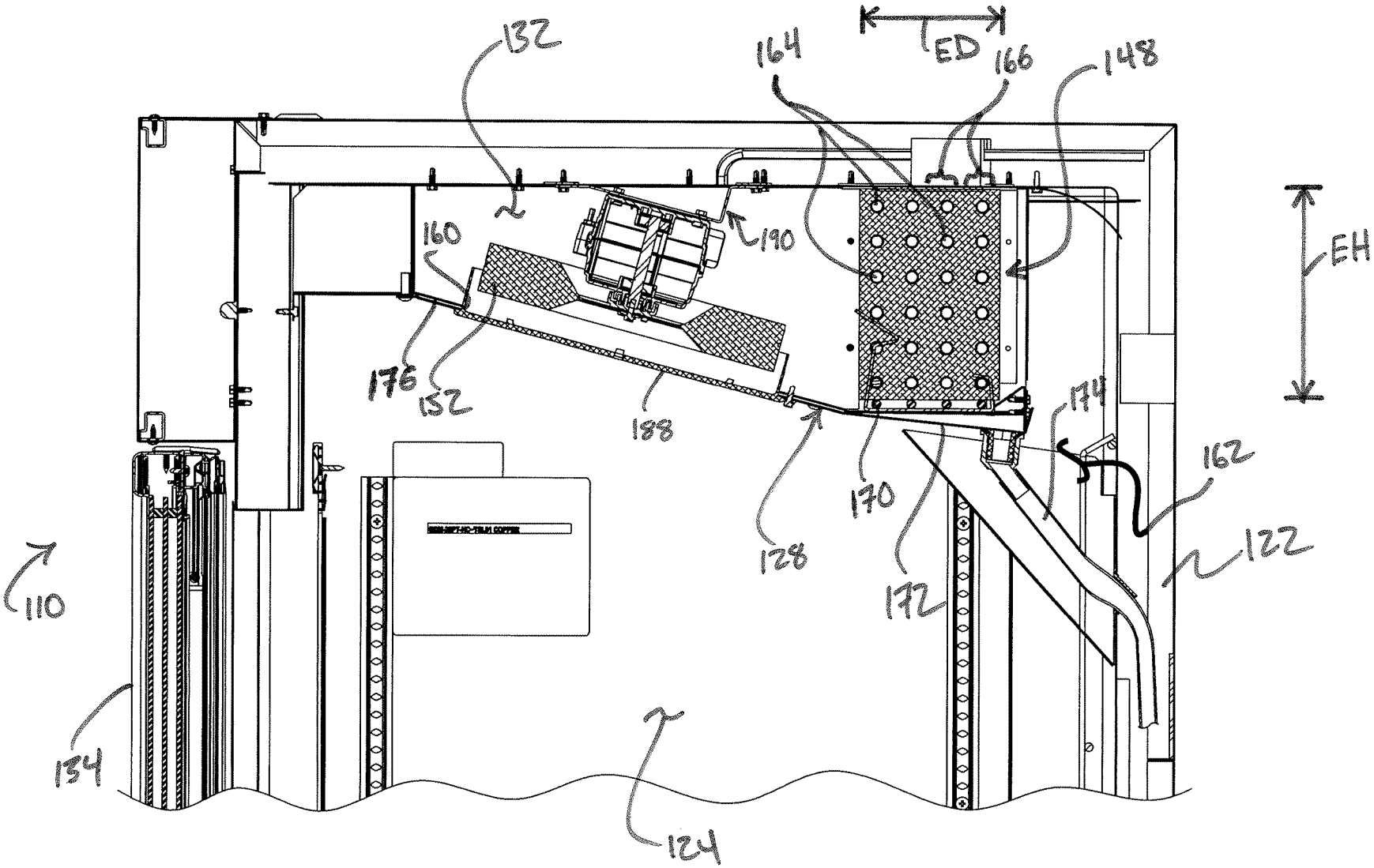
FIG. 5 is an enlarged view of a portion of FIG. 3.
Figure 6:
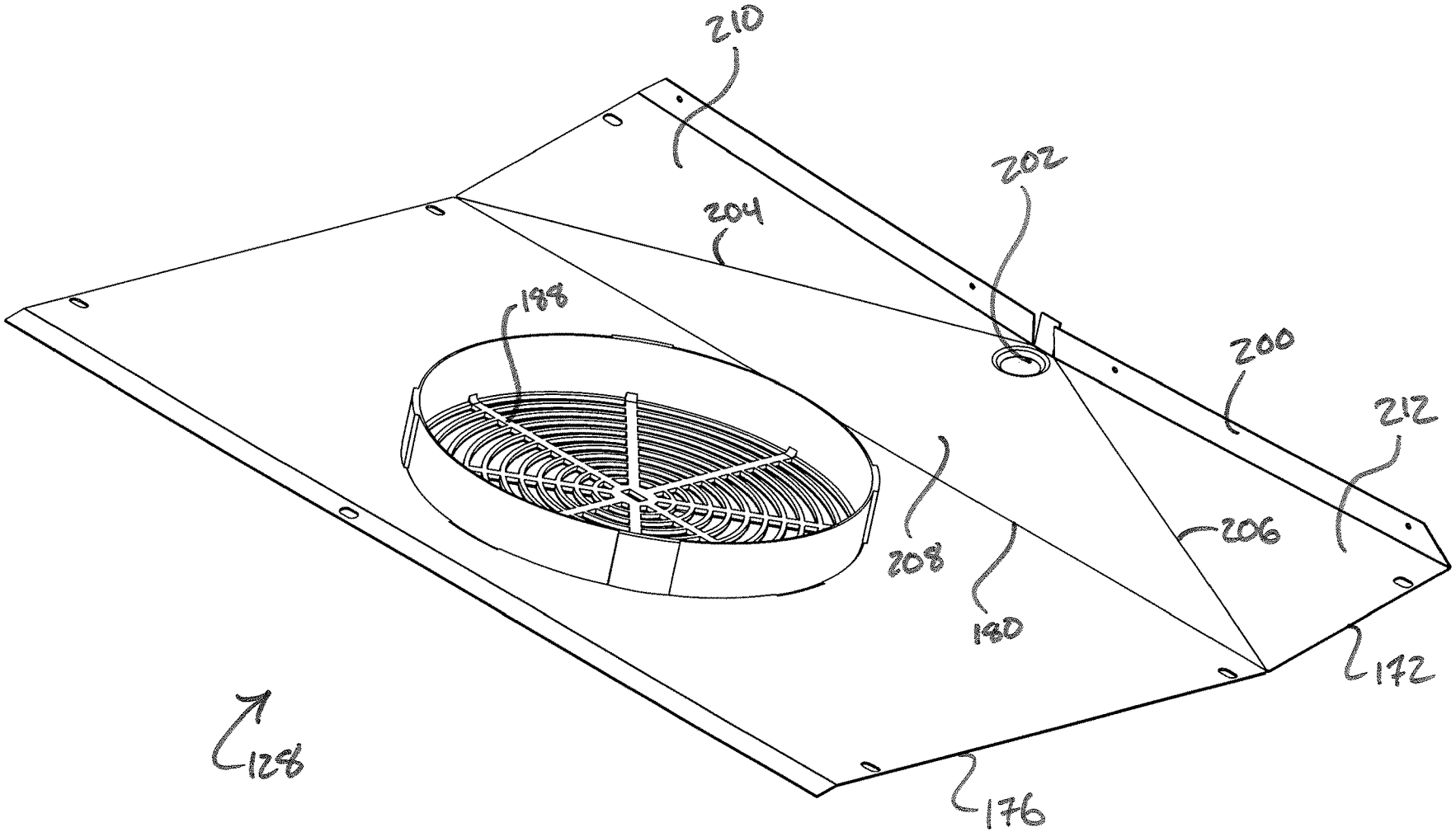
FIG. 6 is a perspective of a sub-assembly of the self-contained reach-in refrigerator including an upper wall and a grill.
Figure 7:
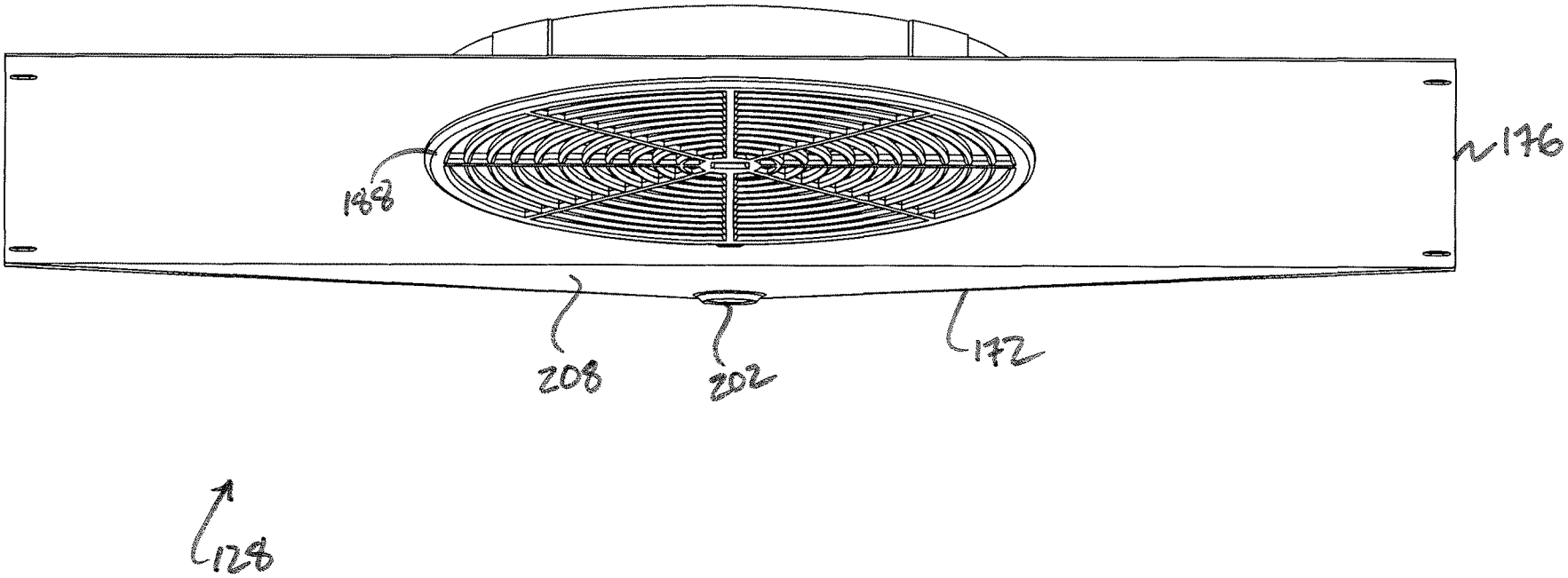
FIG. 7 is a front elevation of the sub-assembly of FIG. 6.
Figure 8:
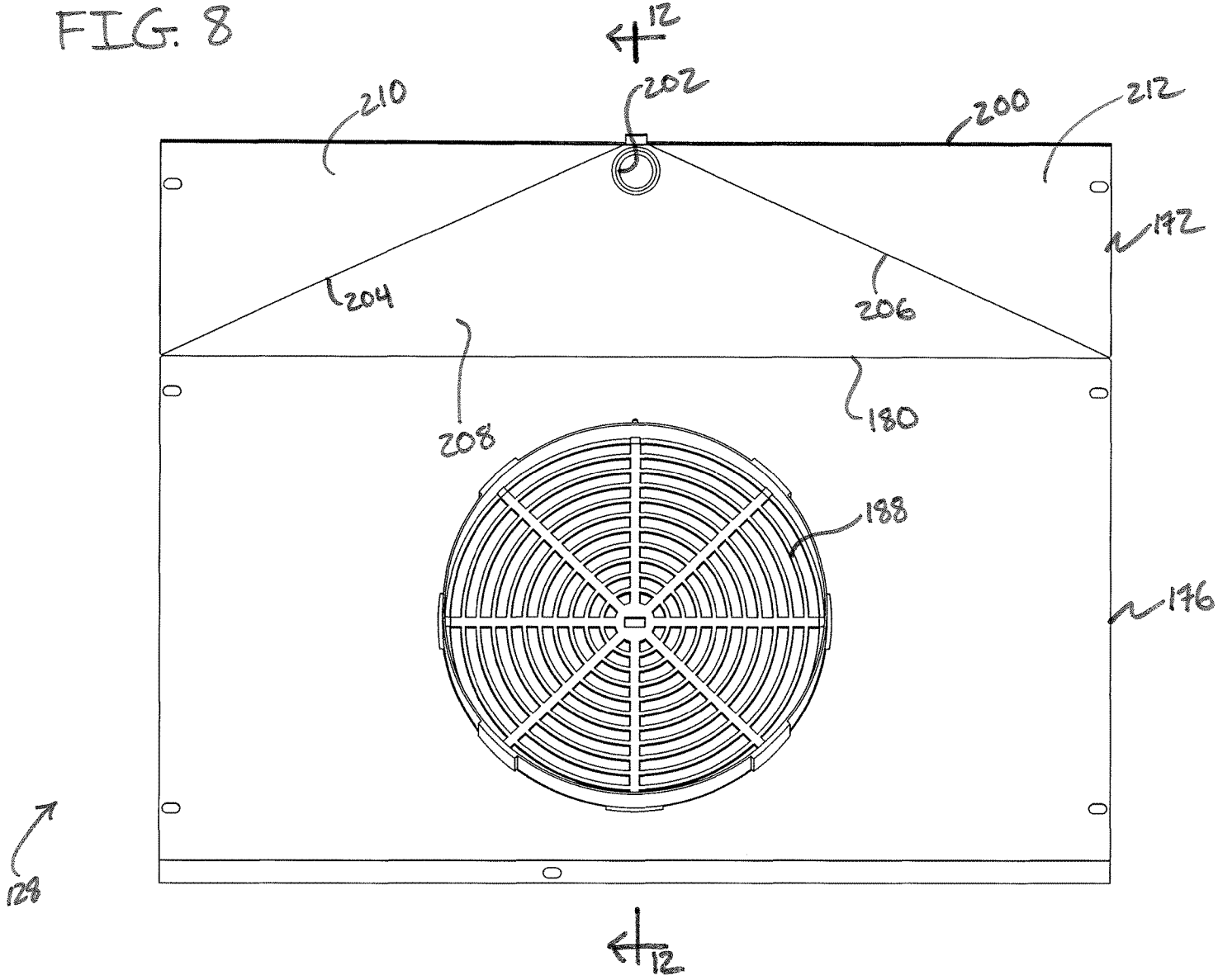
FIG. 8 is a top plan view of the sub-assembly of FIG. 6.

Referring to FIG. 5, the condenser 144 comprises a condenser coil (broadly, a heat exchanger) in which refrigerant vapor condenses into liquid and thereby rejects heat out of the refrigeration system 140. The condenser 144 and the compressor 143 are located in the condenser chamber 130 below the product space 124. A front grill extends across the front of the condenser chamber 130 to provide fluid communication between the condenser chamber and the ambient atmosphere outside the cabinet 112. The illustrated condenser 144 is an air-cooled condenser. An air moving device such as condenser fan 154 (which can be fixed speed or variable speed) is configured to draw ambient room air across the condenser coil 144 so that the air absorbs heat from the condenser coil and heat is thereby rejected from the refrigeration system to the ambient environment. In exemplary embodiments, the condenser fan 154 is a reversible condenser fan configured to periodically run in a reverse direction to force away debris that may collect on the condenser coil as the fan runs in the forward direction during normal use. Inside the condenser chamber 130 is also a condensate tray 156. As will be explained in further detail below, the self-contained reach-in refrigerator is configured drain defrost condensate from the evaporator 148 into the condensate tray 156 such that the water can be heated and evaporated from the condensate tray. In the illustrated embodiment, the refrigeration system 140 heats the condensate tray 156 using a refrigerant discharge loop 158 upstream of the condenser 144. Although it is also possible to use an electrical heater to heat the condensate tray 156, the inventors have found that the discharge loop 158 yields improvements in the overall energy efficiency of the self-contained reach-in refrigerator 110.

The evaporator 148 comprises an evaporator coil (broadly, a heat exchanger) in which liquid refrigerant absorbs heat and changes to vapor, thereby absorbing heat and moisture from the product space. The illustrated evaporator coil 148 is situated in the evaporator plenum 132 above the upper wall 128. An evaporator fan 152 (which can be fixed speed or variable speed) is configured for moving air across the evaporator 148 so that the evaporator absorbs heat from the air to cool the interior storage space 124. The evaporator fan 152 is broadly configured to draw return air from the product space 124 through an inlet 160 in the upper wall 128 and move the air downstream across the evaporator 148 to cool the air. The fan 152 moves the cooled air downstream from the evaporator 148 to an outlet 162 through which the cooled air is discharged into the product space 124. In the illustrated embodiment, the outlet 162 is located along the back wall 122 of the cabinet 112, and the inlet 160 to the evaporator plenum 132 is spaced apart forwardly from the discharge plenum toward the front the cabinet 112. However, it will be understood that the air plenums could have other arrangements (e.g., the outlet could be along one lateral side with the inlet opening adjacent to the opposite lateral side) without departing from the scope of the disclosure.

The illustrated evaporator 148 has an upright configuration that is thought to facilitate efficient heat transfer, yielding improvements in the overall energy efficiency of the self-contained reach-in refrigerator 110 as compared with certain self-contained reach-in refrigerators of the prior art utilizing evaporators that in cross-section are of greater dimension in the cross-wise direction than they are in height. The evaporator 148 has a bottom end and a top end spaced apart along an evaporator height EH, and an evaporator front end (broadly, upstream end) and an evaporator rear end (broadly, downstream end) spaced apart along a front-to-back evaporator depth ED (broadly, a crosswise dimension). The evaporator 148 is shaped and arranged in the evaporator plenum 132 such that the evaporator height EH is greater than the front-to-back evaporator depth ED. For example, in one or more embodiments, the evaporator height EH is at least 125% of the front-to-back evaporator depth ED (e.g., about 150%). The front-to-back evaporator depth ED is broadly a "crosswise dimension" of the evaporator 148 in the direction of flow through the evaporator plenum 132. Although the illustrated crosswise dimension ED runs front-to-back, it will be understood that the crosswise dimension of the evaporator can alternatively be a lateral dimension or otherwise, depending on how the evaporator plenum is arranged in relation to the cabinet.

The evaporator 148 comprises a plurality of widthwise coil sections 164 spaced apart along the evaporator height EH and the front-to-back evaporator depth ED. The plurality of widthwise coil sections 164 are arranged in a plurality of vertical coil section columns 166 spaced apart along the front-to-back evaporator depth ED (broadly, spaced apart along the crosswise dimension of the evaporator). The evaporator 148 comprises a first number of vertical coil section columns 166 and a second number of widthwise coil sections 164 in each vertical coil section column, wherein the first number is less than the second number. In an exemplary embodiment, the second number is at least 125% of the first number (e.g., about 150%). In the illustrated embodiment, the first number is 4 and the second number is 6.

The self-contained reach-in refrigerator further comprises a defrost heater 170 in thermal communication with the evaporator 148 for selectively defrosting the evaporator. The defrost heater 170 selectively heats the evaporator 148 to melt frost on the evaporator coil, thereby forming liquid condensate that falls from the evaporator. As explained more fully below, the self-contained reach-in refrigerator 110 comprises a drain pan 172 below the defrost heater to receive the liquid condensate that melts during defrost. A drain conduit 174 fluidly connects the drain pan 172 to the condensate tray 156 in the condenser chamber 130 below the product space 124 such that the defrosted water drains into the condensate tray 156 where it can be evaporated by heat supplied via the discharge loop 158. In the illustrated embodiment, the defrost heater 170 comprises an electrical resistance heating element, but other embodiments can use other heating elements without departing from the scope of the disclosure.

Referring to FIGS. 6-12, in the illustrated embodiment, the drain pan 172 is formed by a drain pan section of the upper wall 128. It contemplated that, in alternative embodiments, the drain pan 172 can be formed separately from the upper wall 128 without departing from the scope of the disclosure. The upper wall 128 further comprises a fan section 176 extending forward from the drain pan section 172. In one or more embodiments, the fan section 176 and drain pan section 172 of the upper wall 128 are formed from a single monolithic piece of sheet metal. For instance, in the illustrated embodiment, the fan section 176 and the drain pan section 172 are sections of the same piece of sheet meal joined together at a crease 180.

Figure 15A:
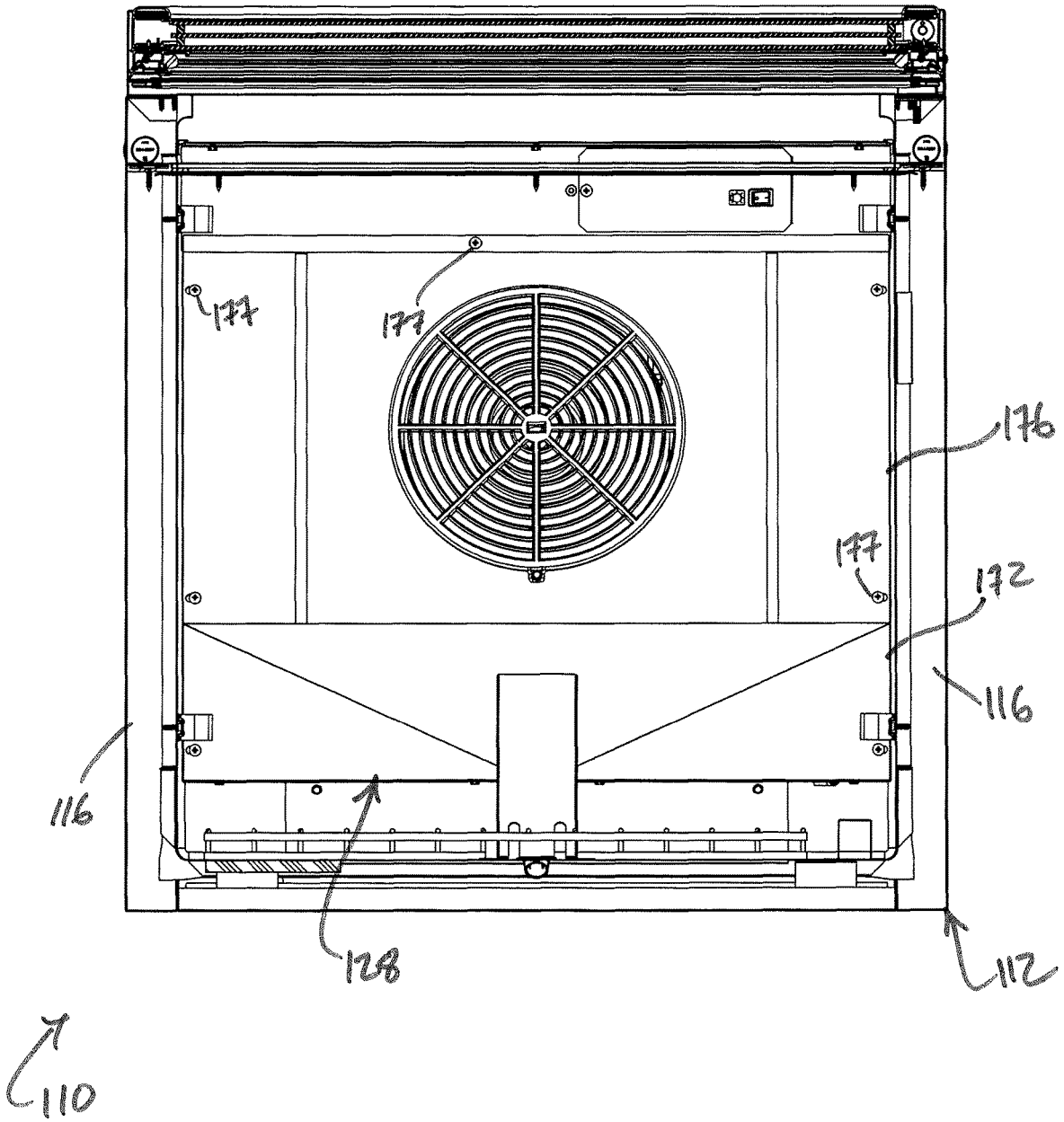
FIG. 15A is a cross section taken in the plane of line 15-15 of FIG. 2.
Figure 15B:
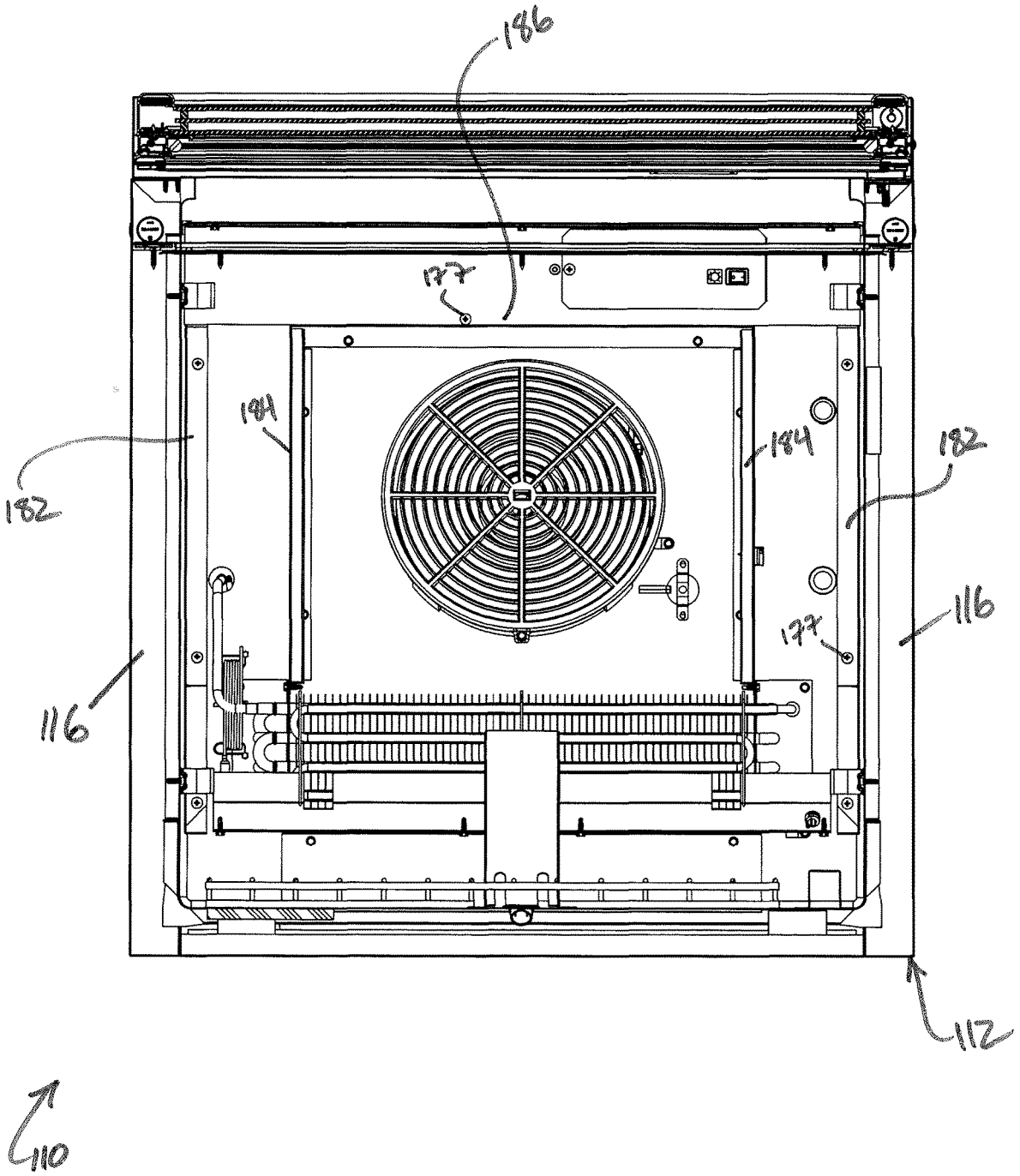
FIG. 15B is a cross section similar to FIG. 15A but with the upper wall removed.

As shown in FIGS. 15A-15B, the one-piece upper wall 128 is removably coupled to the cabinet 112 such that the drain pan section 172 and the fan section 176 can be selectively removed as a unit in one piece. The upper wall 128 is removably coupled to the cabinet 112 by a plurality of removable fasteners 177. In an exemplary embodiment, the upper wall 128 is removably coupled to the cabinet 112 by fewer than 12 removable fasteners 177 (e.g., fewer than 10 removable fasteners, fewer than 8 removable fasteners, or exactly seven removable fasteners). In the illustrated embodiment, the cabinet 112 includes a side rail 182 adjacent to each of the cabinet side walls 116 at a location spaced apart below the cabinet top wall 118. The rails 182 include pre-threaded openings (e.g., nuts) that are configured to threadably receive machine screws 177 (broadly, removable fasteners) that secure the respective lateral edge margin of the one-piece upper wall to the cabinet 112. Each side rail 182 has an angled shape that corresponds to the shape of the lateral edge margins of the sheet metal wall 128, as it is bent at the crease 180. The illustrated cabinet further comprises an inner front lip 186 with a single threaded opening (e.g., nut) to receive a single machine screw 177 that secures the front edge margin of the one-piece upper wall to the cabinet.

To uncover the evaporator 128, the evaporator fan 152, and the defrost heater 170, the user only needs to remove the removable fasteners 177 (e.g., <12 removable fasteners) and then take out the one-piece upper wall 128. As explained above, in an exemplary embodiment, the removable fasteners 177 are machine screws rather than sheet metal screws. The inventors have found that the way of mounting the illustrated upper wall 128 to the refrigerated cabinet 112 offers several advantages over conventional reach-in cabinet configurations. Firstly, the machine screws allow the upper wall 128 to be removed and reinstalled numerous times without failure, whereas prior art sheet metal screw fasteners are prone to stripping with repeated use. Additionally, prior art self-contained reach-in refrigerators often required removal of well in excess of 12 screws and removal of more than one wall piece to fully access the evaporator, evaporator fan, and/or defrost heater. So by contrast, there are substantial improvements in case-of-access and serviceability with the illustrated upper wall 128.

In the illustrated embodiment, side walls 184 of the evaporator plenum 132 are suspended from the top wall 118 at locations spaced apart inboard of the cabinet side walls 116 and the rails 182. Thus, in the illustrated embodiment, the evaporator plenum 132 has a width that is less than the overall width of the inside of the cabinet 112. Gaskets are fitted onto the bottom edges of the side walls 184 for being sealingly compressed between the side walls and the upper wall 128 when the upper wall is installed. It will be understood that the evaporator plenum can extend the full width of the cabinet in one or more embodiments.

Figure 14:
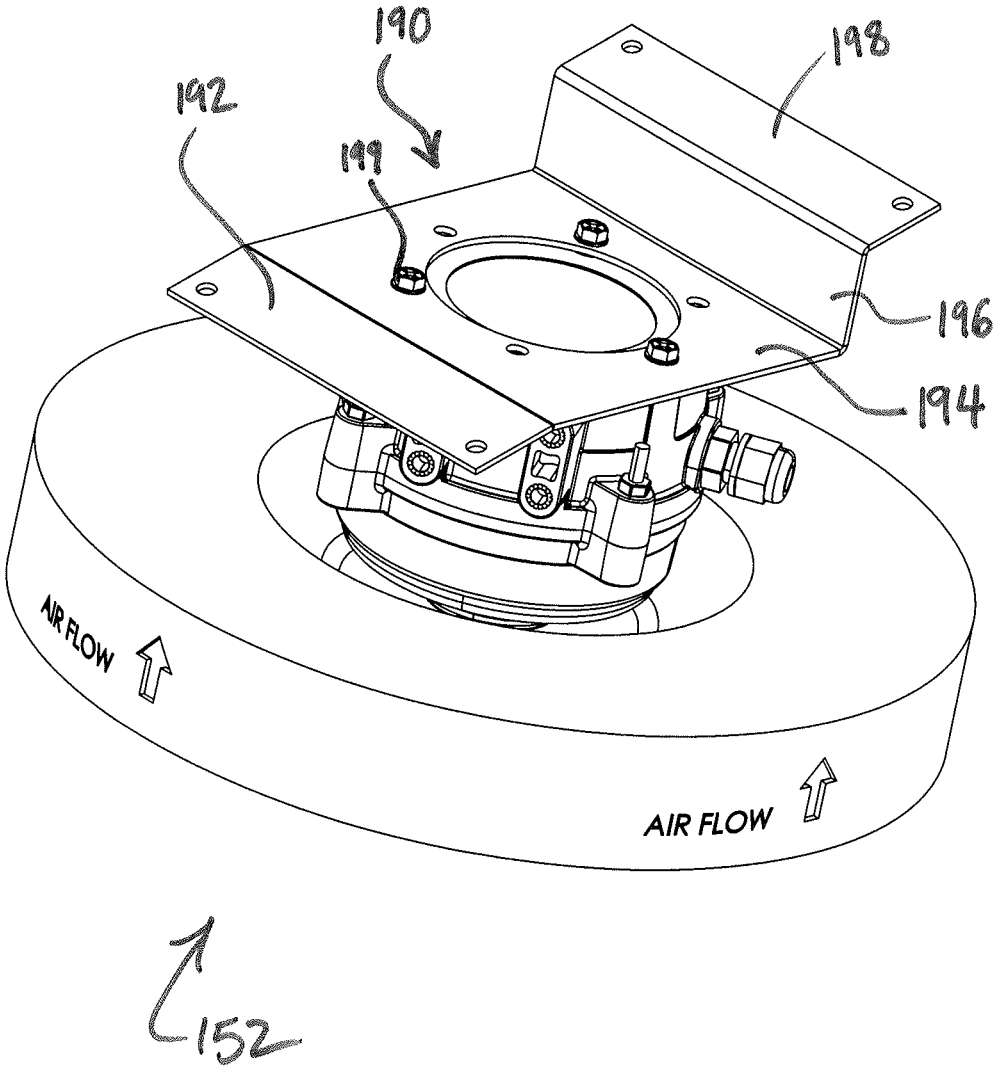
FIG. 14 is a perspective of a fan assembly of the self-contained reach-in refrigerator.

Referring to FIGS. 5 and 14, the evaporator fan 152 is supported over the fan section 176 of the upper wall 128 and the air inlet 160 is formed through the fan section such that the evaporator fan is configured to draw air from the product space 124 generally vertically through the upper wall fan section 176. In one or more embodiments, a fan grill 188 is fastened to the upper wall 128 across the air inlet 160. In an exemplary embodiment, the evaporator fan 152 itself is not fastened to the upper wall 128, but rather is fastened to and supported on the top wall 118 of the cabinet 112, which is spaced apart above the upper wall 128. The illustrated self-contained reach-in refrigerator 110 comprises a fan bracket 190 for attaching the evaporator fan 152 to the top wall 118. Suitably, the fan bracket 190 mounts the evaporator fan on the cabinet 112 such that the fan blade rotates in a plane substantially parallel to or coplanar with the plane of the fan section 176 of the upper wall 128. In the illustrated embodiment the fan bracket 190 comprises a front section 192 fastened (e.g., by removable fasteners such as screws) to the top wall 118, a motor retention section 194 extending downward and rearward from the front section 192 at an angle substantially parallel to the fan section 176 of the upper wall 128, an upright section 196 extending generally vertically from a rear end of the motor retention section, and a rear section 198 fastened (e.g., by removable fasteners such as screws) to the top wall. The motor retention section 194 is secured to the fan motor of the evaporator fan 152 by a set of screws 199. The inventors have found that attaching the evaporator fan directly to the top wall 118 improves the durability of the upper wall 128 by isolating the upper wall from fan vibrations.

Referring to FIGS. 5-12, the bottom side of the fan section 176 of the upper wall 128 is directly exposed to the product space 124. In addition, the fan section 176 slopes downward as it extends front-to-back inside the cabinet 112. The fan section 176 has a front end adjacent the mounting lip 186 and a rear end joined to the front end portion of the drain pan section 172 at the crease 180. The fan section 176 slopes downward as it extends from its front end to its rear end. In one or more embodiments, the fan section 176 slopes at a front-to-back slope angle SA1 (FIG. 10) in an inclusive range of from 5° to 30° (e.g., in an inclusive range of from 10° to 20°). As compared with self-contained reach-in refrigerators that provide a fan inlet through a more horizontal wall section, the inventors have found that the illustrated sloping fan section 176 yields improvements in temperature performance and efficiency. In particular, the sloping bottom surface of the fan section 176 makes it less likely that product will meaningfully interfere with air flow into the evaporator plenum 132 through the air inlet 160. For instance, if a large rectangular package were loaded onto a horizontal top self of the illustrated self-contained refrigerated merchandiser 110, even if the package were positioned in contact with the upper wall 128 directly in front of the air inlet 160, the evaporator fan 152 could still draw air across the horizontal top of the package and vertical rear side of the package through the air inlet 160 into the evaporator plenum 132. If the same package were loaded onto the horizontal top shelf of a self-contained refrigerated merchandiser with a horizontal air inlet, the top of the package could completely cover and substantially obstruct air flow through the air inlet. By orienting the fan section 176 and air inlet 160 in a downward and reward sloping plane, the illustrated self-contained refrigerated merchandiser 110 can provide improved cooling reliability and energy-efficiency.

The drain pan section 172 comprises a front end portion joined to the fan section 176 at the crease 180 and a rear end portion from which a rear lip 200 of the upper wall 128 extends upward in a generally vertical plane. The rear lip 200 forms the rear wall of the drain pan whose bottom is formed by the drain pan section 172. The front end portion and the rear end portion of the drain pan section 172 are spaced apart along a front-to-back depth of the drain pan. The drain pan section 172 further comprises a left side portion and a right side portion spaced apart along a width of the drain pan. In the illustrated embodiment, the drain pan section 172 extends along the full width of the evaporator plenum 132. The drain pan section 172 comprises a drain opening 202 at the rear end portion centrally located between the left side portion and the right side portion. A fitting of the drain conduit 174 is received in the drain opening 202 (see FIG. 5) such that water in the drain pan section 172 can flow toward the drain opening 202 into the drain conduit, thereby draining water into the condensate tray 156.

The drain pan section 172 is generally configured to guide water that settles anywhere along the front-to-back depth and lateral width of the bottom of the drain pan to flow toward the drain opening 202. More particularly, the drain pan section 172 is situated below the evaporator 148 such that any liquid condensate that falls off of the evaporator during defrost will land on the drain pan section and flow from wherever it lands toward the drain opening 202. In other words, the drain pan section 172 is shaped and arranged to minimize the extent to which water can settle and pool anywhere along the drain pan section 172—other than at the drain opening. In general, the drain pan section 172 slopes downward as the drain pan section extends front-to-back from the front end portion to the rear end portion. Further, the illustrated drain pan section 172 is configured to slope downward as the drain pan section extends widthwise from the right side portion to the drain opening 202 and to slope downward as the drain pan section extends widthwise from the left side portion to the drain opening.

In the illustrated embodiment, the drain pan section comprises left and right diagonal gutter creases 204, 206. The left gutter crease 204 slopes downward from the front left corner of the drain pan section 172 to the drain pan opening 202, and the right gutter crease 206 slopes downward from the front right corner of the drain pan section to the drain pan opening. The gutter creases 204, 206 define three planar triangular segments 208, 210, 212 along the drain pan section 172. The left gutter crease 204 defines a boundary between a central triangular segment 208 and a left triangular segment 210, and the right gutter crease 206 defines a boundary between the central triangular segment and a right triangular segment 212. The triangular segments 210, 212, 214 slope toward the gutter creases 204, 206 such that water on any of the triangular segments is directed to flow toward the gutter creases and the drain pan opening 202.

The central triangular segment 208 is defined by the widthwise front edge of the drain pan section 172 and the left and right gutter creases 204, 206. The central triangular segment 208 extends in a plane sloping front to back at a slope angle SA2. The central triangular segment does not have widthwise slope. In one or more embodiments, the slope angle SA2 (FIG. 12) is in an inclusive range of from 2° to 20° (e.g., in an inclusive range of from 3° to 10°). In certain embodiments, the slope angle SA2 is less than the slope angle SA1.

Figure 9:
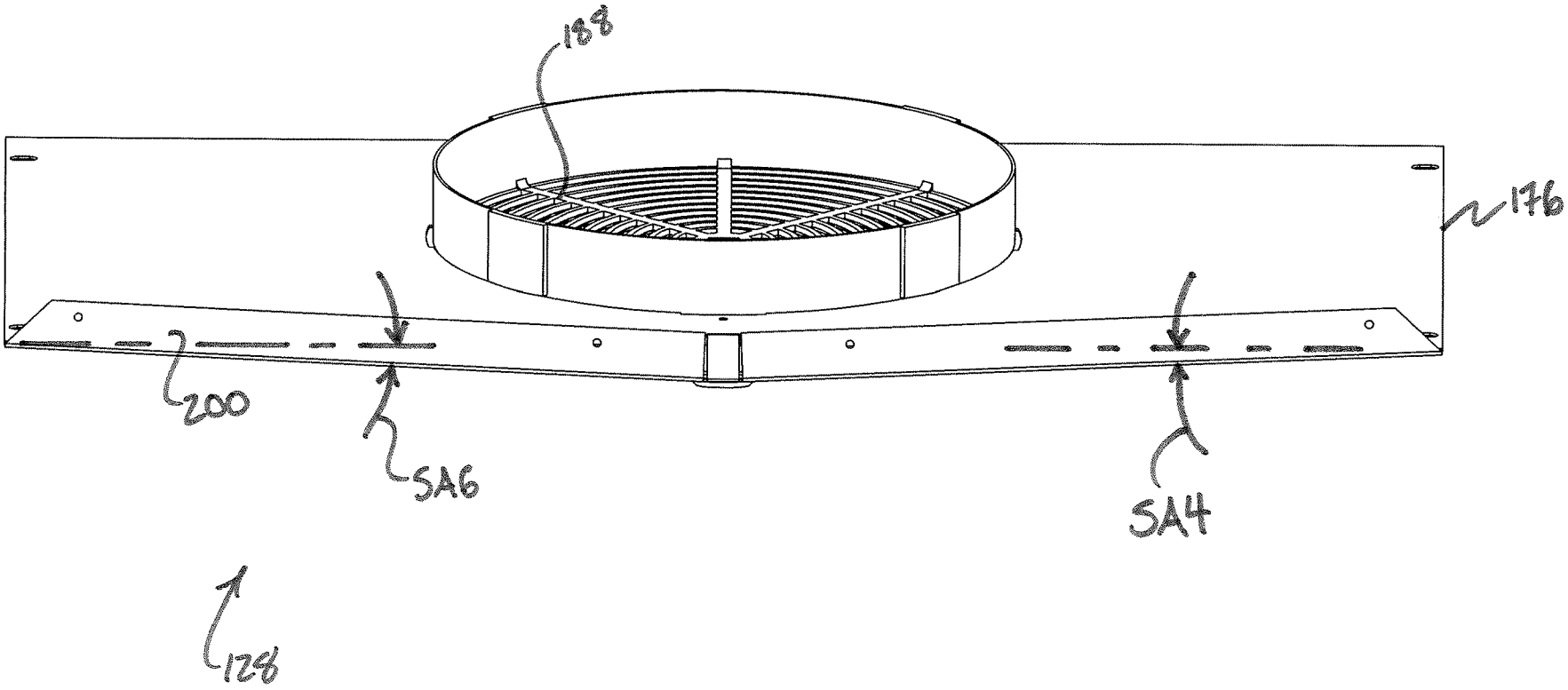
FIG. 9 is a rear elevation of the sub-assembly of FIG. 6.
Figure 10:
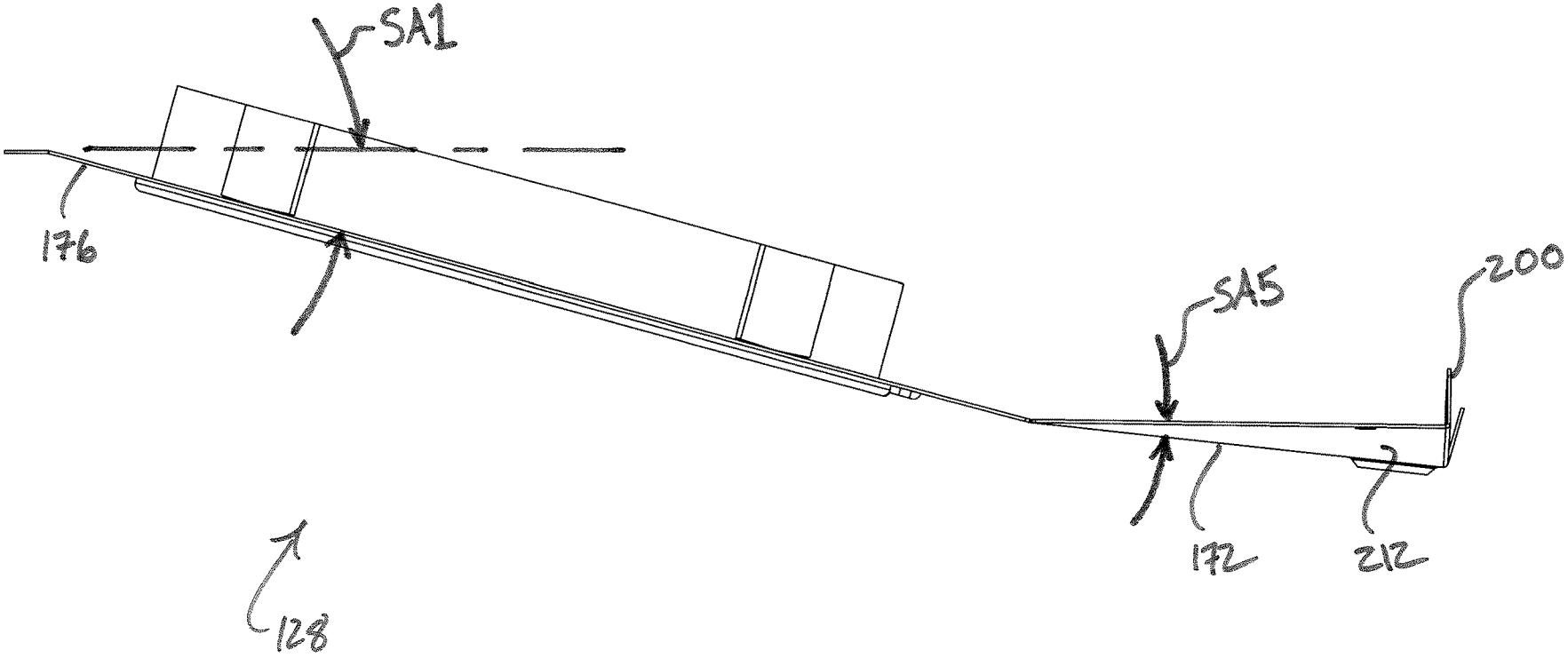
FIG. 10 is a right side elevation of the sub-assembly of FIG. 6.
Figure 11:
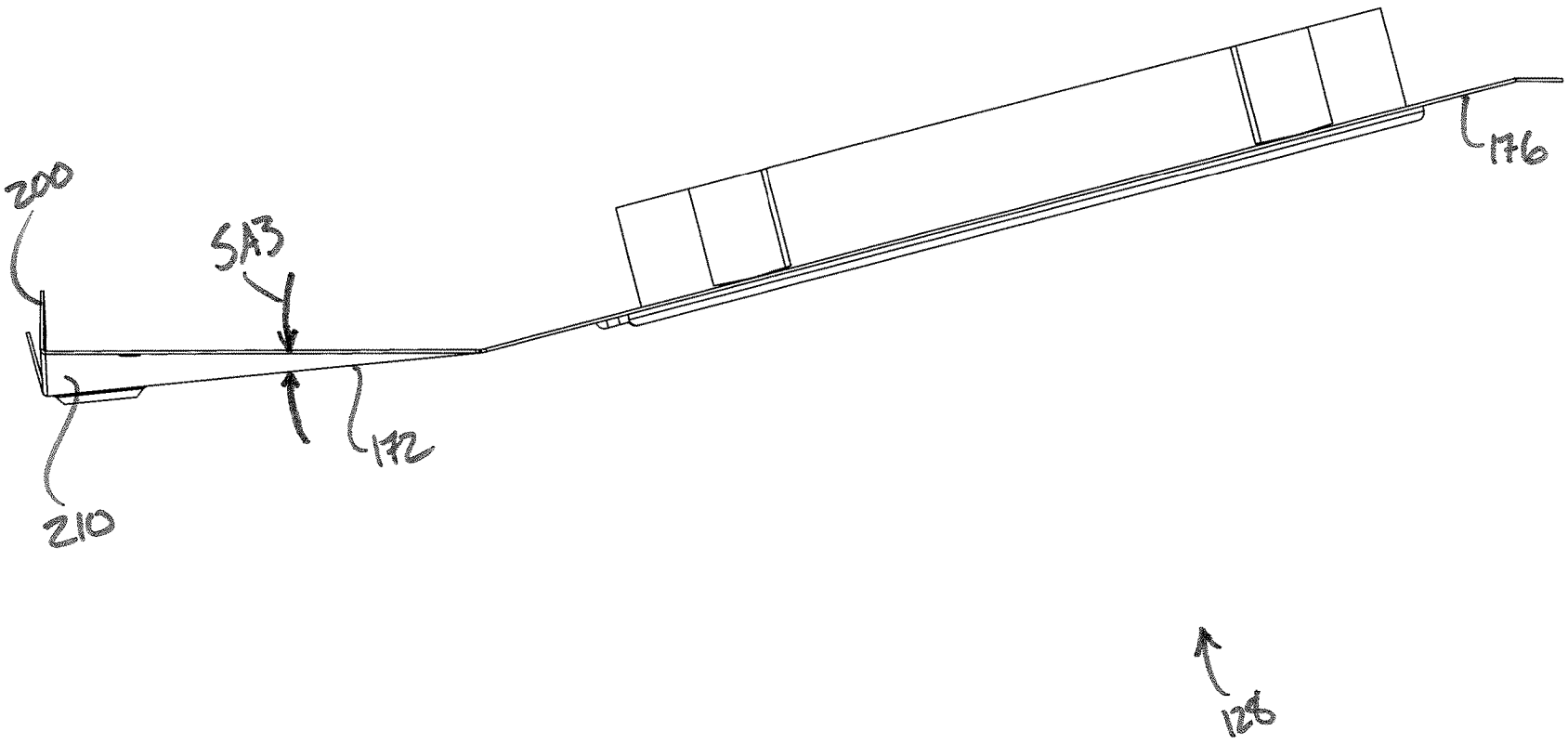
FIG. 11 is a left side elevation of the sub-assembly of FIG. 6.
Figure 12:
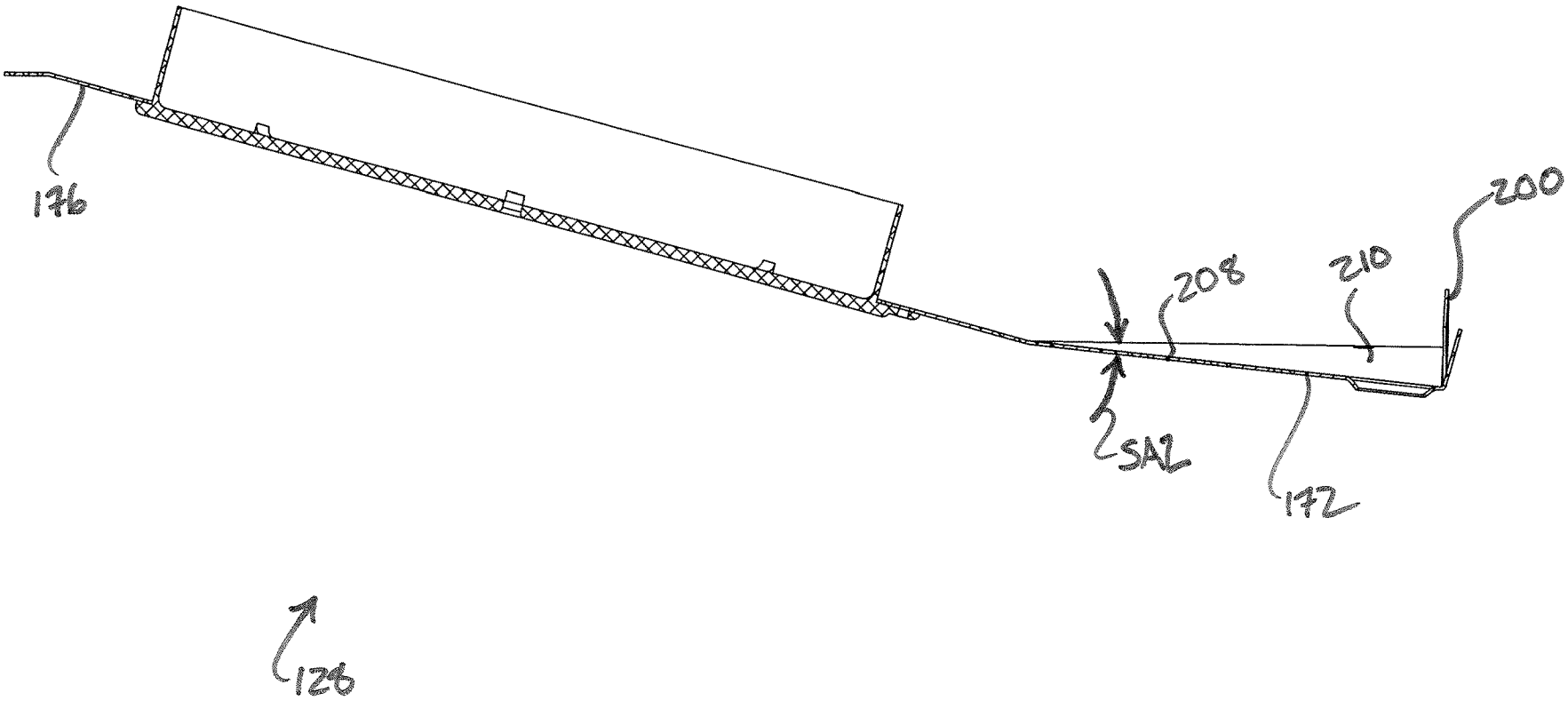
FIG. 12 is a cross section taken in the plane of line 12-12 of FIG. 8.

The left triangular segment 210 defines the front-to-back left edge of the drain pan section 172 and has a front edge defined by the left gutter crease 204 and a rear edge defined at a joint (e.g., crease) between the drain pan section 172 and the rear lip 200. The left triangular segment 210 extends in a plane that is non-parallel to the plane of the central triangular segment 208. The left triangular segment 210 slopes front-to-back at a front-to-back slope angle SA3 (FIG. 11) and slopes downward left-to-right at left-to-right slope angle SA4 (FIG. 9). In one or more embodiments, the front-to-back slope angle SA3 is in an inclusive range of from 2° to 20° (e.g., in an inclusive range of from 3° to 10°). In certain embodiments, the left-to-right slope angle SA4 is in an inclusive range of from 2° to 15° (e.g., in an inclusive range of from 2° to 8°). In the illustrated embodiment, the left-to-right slope angle SA4 is less than the front-to-back slope angle SA3.

The right triangular segment 212 defines the front-to-back right edge of the drain pan section 172 and has a front edge defined by the right gutter crease 206 and a rear edge defined at a joint (e.g., crease) between the drain pan section 172 and the rear lip 200. The right triangular segment 212 extends in a plane that is non-parallel to the planes of the central triangular segment 208 and the left triangular segment 210. The right triangular segment 212 slopes front-to-back at a front-to-back slope angle SA5 (FIG. 10) and slopes downward right-to-left at right-to-left slope angle SA6 (FIG. 9). In one or more embodiments, the front-to-back slope angle SA5 is in an inclusive range of from 2° to 20° (e.g., in an inclusive range of from 3° to 10°). In certain embodiments, the right-to-left slope angle SA6 is in an inclusive range of from 2° to 15° (e.g., in an inclusive range of from 2° to 8°). In the illustrated embodiment, the right-to-left slope angle SA6 is less than the front-to-back slope angle SA5.

The inventors have found that the three-segment drain pan section 172 can yield improvements in refrigeration performance and reliability. Conventional drain pans in this type of refrigerator include bottom walls that slope in a single plane. The inventors have found that the conventional type of single-plane drain pan can allow water to settle in certain locations. Moreover, the settled water can freeze on the drain pan, and once ice begins to form, it can propagate, eventually forming a substantial mass of solid ice that can block the drain conduit and lead to a malfunction that requires servicing. By contrast, the inventors have discovered that the left and right gutters 204, 206 of the illustrated drain pan section 206 substantially prevent any water from settling on the drain pan and thus limit the possibility for ice to form on the drain pan. Furthermore, the conventional single-plane drain pan design employs a significant number of seams sealed by silicone sealant. The three-segment drain pan section 172 eliminates some of the silicone joints and minimizes the extent to which silicone joints are likely to contact water. Those skilled in the art will recognize that this reduces the points of potential leakage failure in the drain pan.

Figure 13:
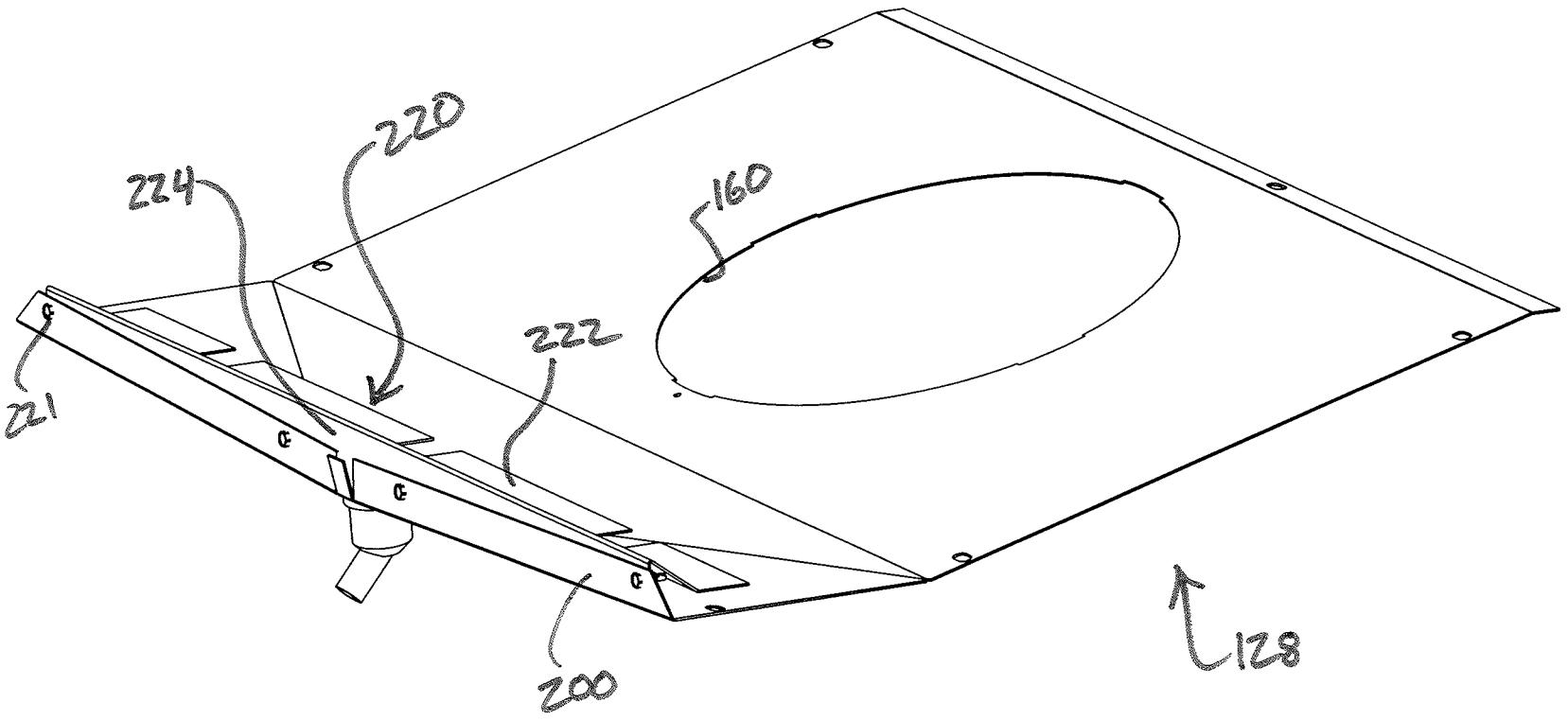
FIG. 13 is a perspective of a sub-assembly of the self-contained reach-in refrigerator including the upper wall and a thermal bridge member.
Figure 16:
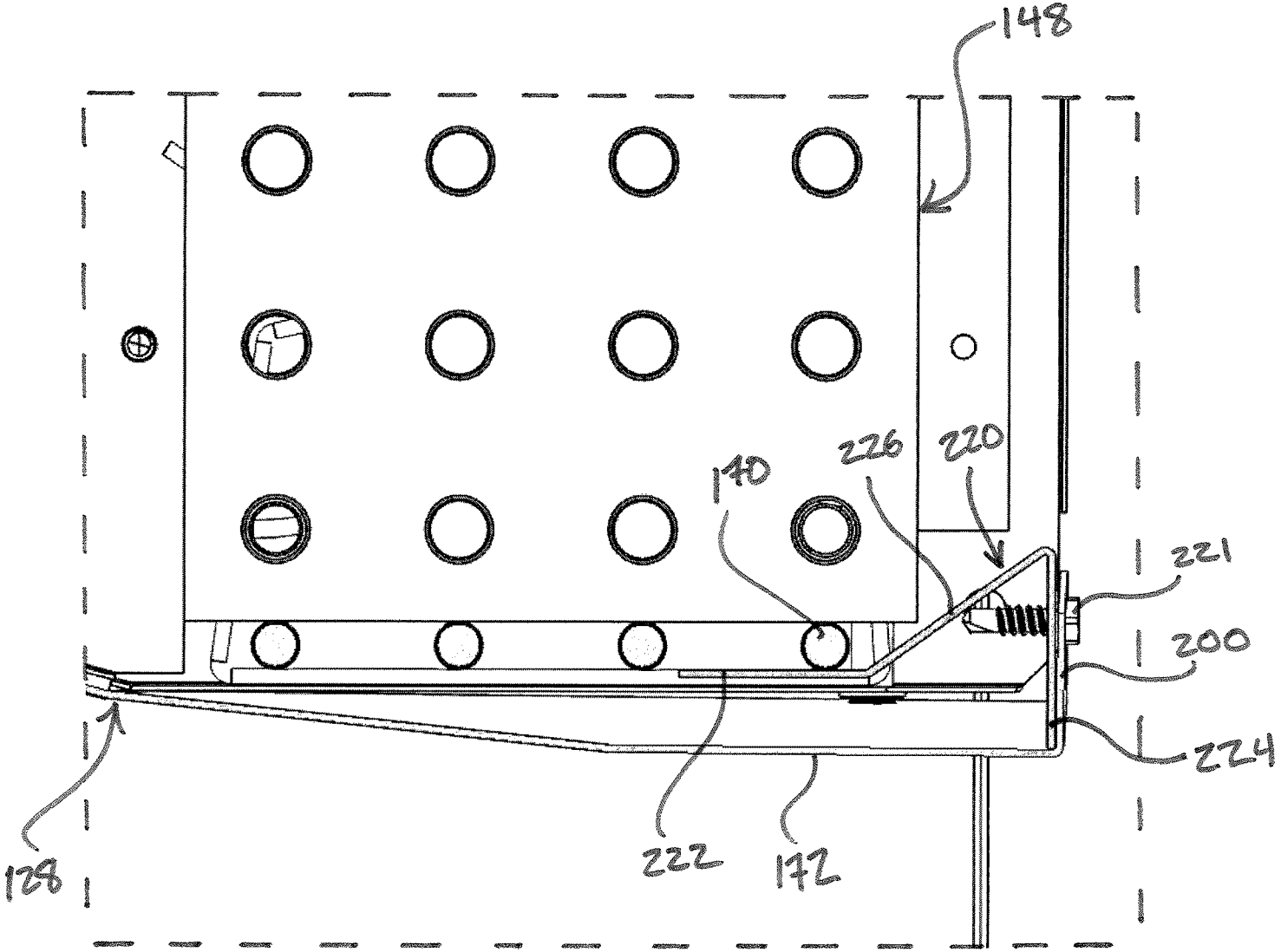
FIG. 16 is an enlarged view of a portion of a cross section of the self-contained reach-in refrigerator taken in the plane of line 16-16 of FIG. 2.

Referring to FIGS. 13 and 16, the illustrated self-contained reach-in refrigerator 110 is configured to further minimize the possibility of ice forming on the drain pan 172 because it includes a thermally conductive bridge member 220 providing thermal conduction between the defrost heater 170 and the drain pan. In the illustrated embodiment, the thermally conductive bridge member 220 is a separate piece of sheet metal that is connected to the lip 200 of the upper wall 128 (e.g., by screws 221), but it is contemplated that the thermally conductive bridge member 220 could also be formed as an extension from the same piece of sheet metal that forms the upper wall 128. The thermally conductive bridge member 220 is in direct contact with the drain pan 172 and is in direct contact with the defrost heating element 170. The thermally conductive bridge member 220 comprises a front section 222 and a rear section 224 spaced apart from the front section in a front-to-back direction. The thermally conductive bridge member 220 further comprises a middle section 226 extending front-to-back from the front section 222 to the rear section 224. The front section 222 is substantially horizontal and in direct contact with the defrost heater 170. The rear section 224 is substantially vertical and in face-to-face contact with the rear lip 200. The middle section 226 is angled to extend upward as it extends front-to-back from the front section 222 to the rear section 224. As explained above, the drain pan 172 has a width. The rear section 224 desirably has face-to-face contact with the rear lip 200 along more than 25% (e.g., more than 50%) of the width of the drain pan. Preferably, the thermally conductive bridge member 220 has direct contact with each of the drain pan and the heating element along more than 25% (e.g., more than 50%) of the width.

The thermally conductive bridge member 220 conducts heat from the defrost heater 170 to the drain pan 172 during every defrost cycle. This melts ice that forms on the drain pan 172 and thus keeps the drain pan substantially clear of ice. It will be understood that, conceptually, a thermally conductive bridge member can be used to melt ice on any drain pan below an evaporator with a defrost heater. Thus adaptations of the thermally conductive bridge member 220 can be used to provide conductive heat transfer to drain pans of any shape and configuration without departing from the scope of the disclosure.

In one or more embodiments, the upper wall 128 is made of aluminum and the thermally conductive bridge member 220 is also made of aluminum (broadly, the upper wall and the conductive bridge member are separate components made from the same type of thermally conductive material). The inventors have found that aluminum provides good thermal conduction for the application. Moreover, the inventors prefer to form the upper wall 128 and bridge member 220 from the same material to inhibit galvanic corrosion.

It can be seen that in the illustrated embodiment, the rear lip 200 of the upper wall 128 is formed in separate left and right sections spaced apart by a central gap aligned with the drain opening 202. This construction enables the entire upper wall 128 to be formed from a single monolithic piece of sheet metal. More particularly, this construction enables the drain pan section 172 to include left and right triangular segments 210, 212 that slope in opposing directions. However, the inventors have recognized that the gap provided between the left and right sections of the rear lip 200 is a point of weakness under load. For example, when the drain pan 172 is filled with liquid the upper wall 128 may deform under the added weight. In the illustrated embodiment the rear section 224 of the thermal bridge member 220 forms a support member, separate from the cabinet 112, that is fastened to the rear lip 200 to support the upper wall 128 within the cabinet. It is contemplated that, in one or more embodiments, a support member can support the upper wall in the same manner as the rear section 224 of the thermal bridge member 220, wherein the support member is not part of a thermal bridge to the defrost heater. Generally speaking, a suitable support member 224 comprises a plate fastened face-to-face with the rear lip 200. Such a plate 224 can be fastened face-to-face with both the left and right sections of the rear lip 200. In an exemplary embodiment, the plate 224 has a first portion in face-to-face contact with the left section of the rear lip 200, a second portion in face-to-face contact with the right section of the rear lip, and extends continuously from the first portion to the second portion across the gap formed in the rear lip.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products and methods without departing from the scope of the disclosure, it is intended that all matter contained in the above description shall be interpreted as illustrative and not in a limiting sense.

What is claimed is:

1. A self-contained reach-in refrigerator comprising:

a cabinet defining a product space having a front-to-back depth, a width, and an upper end;

a self-contained refrigeration system connected to the cabinet, the self-contained refrigeration system comprising an evaporator, a compressor, a condenser, an expansion device, and interconnecting tubing;

an evaporator fan configured to draw air from the product space across the evaporator to cool the air and discharge cooled air into the product space;

a defrost heater in thermal communication with the evaporator for selectively defrosting the evaporator;

an upper wall in the cabinet and defining the upper end of the product space, the upper wall including a drain pan section below the evaporator, a fan section extending forward from the drain pan section, and a rear lip extending upward from a rear end of the drain pan section, the evaporator fan being supported over the fan section to draw air from the product space through the fan section; and a support member fastened to the rear lip, the support member being separate from the cabinet and configured to support the upper wall within the cabinet.

2. The self-contained reach-in refrigerator as set forth in claim 1, wherein the support member comprises a plate fastened face-to-face with the rear lip.

3. The self-contained reach-in refrigerator as set forth in claim 1, wherein the drain pan section comprises a drain opening and the rear lip comprises left and right sections on left and right sides of the drain opening.

4. The self-contained reach-in refrigerator as set forth in claim 3, wherein the support member comprises a plate fastened face-to-face with both the left and right sections of the rear lip.

5. The self-contained reach-in refrigerator as set forth in claim 4, wherein the rear lip comprises a gap between the left and right sections of the rear lip, the plate having a first portion in face-to-face contact with the left section of the rear lip, a second portion in face-to-face contact with the right section of the rear lip, and extending continuously from the first portion to the second portion across the gap.

6. The self-contained reach-in refrigerator as set forth in claim 1, wherein the fan section, the drain pan section, and the rear lip are formed from a single monolithic piece of sheet metal.

7. The self-contained reach-in refrigerator as set forth in claim 6, wherein the upper wall is removably coupled to the cabinet such that the drain pan section and the fan section can be selectively removed as a unit in one piece.

8. The self-contained reach-in refrigerator as set forth in claim 7, wherein the upper wall is removably coupled to the cabinet by fewer than 12 removable fasteners.

9. The self-contained reach-in refrigerator as set forth in claim 8, wherein the removable fasteners are machine screws.

10. The self-contained reach-in refrigerator as set forth in claim 1, wherein the fan section has a front end and a rear end joined to the front end portion of the drain pan section, the fan section sloping downward from the front end to the rear end.

11. The self-contained reach-in refrigerator as set forth in claim 10, wherein the fan section has a bottom surface exposed directly to the product space.

12. The self-contained reach-in refrigerator as set forth in claim 1, wherein the cabinet comprises a top wall above the upper wall, the evaporator fan fastened directly to the top wall.

13. The self-contained reach-in refrigerator as set forth in claim 1, wherein the evaporator has an evaporator height and an evaporator front-to-back depth, the evaporator being shaped and arranged above the drain pan section such that the evaporator height is greater than the evaporator crosswise dimension.

14. The self-contained reach-in refrigerator as set forth in claim 13, wherein the evaporator height is at least 125% of the evaporator crosswise dimension.

* * * * *